United States Patent [19]

Hultgren

[11] Patent Number: 4,984,919

[45] Date of Patent: Jan. 15, 1991

[54] LIPSTICK-TYPE COSMETIC CASE

[75] Inventor: George W. Hultgren, Fairfield, Conn.

[73] Assignee: Lake Eyelet Manufacturing Company, Incorporated, Southington, Conn.

[21] Appl. No.: 421,265

[22] Filed: Oct. 13, 1989

[51] Int. Cl.[5] ..... A45D 40/06; A45D 40/12

[52] U.S. Cl. ..... 401/78; 401/74; 401/98; 401/87

[58] Field of Search ..... 401/78, 74, 79, 86, 401/87, 98

[56] References Cited

U.S. PATENT DOCUMENTS

| | | | |
|---|---|---|---|
| 1,695,407 | 12/1928 | Anderson . | |
| 1,695,625 | 12/1928 | Wild . | |
| 2,104,902 | 1/1938 | Morrison . | |
| 2,238,368 | 4/1941 | Parkin . | |
| 2,545,848 | 3/1951 | Hopgood . | |
| 2,630,215 | 3/1953 | Lynn | 401/78 |
| 2,798,598 | 7/1957 | Abbotts | 401/78 |
| 3,153,479 | 10/1964 | Hultgren . | |
| 3,308,939 | 3/1967 | Sakalys | 401/78 |
| 3,506,368 | 4/1970 | White . | |
| 4,108,558 | 8/1978 | Radice et al. . | |
| 4,166,707 | 9/1979 | Zawacki, Jr. et al. . | |
| 4,380,402 | 4/1983 | Andrews et al. . | |

FOREIGN PATENT DOCUMENTS

| | | | |
|---|---|---|---|
| 671829 | 12/1929 | France | 401/78 |
| 1008675 | 4/1952 | France . | |
| 1040240 | 10/1953 | France | 401/78 |
| 506428 | 5/1939 | United Kingdom . | |
| 749343 | 5/1956 | United Kingdom . | |

*Primary Examiner*—Steven A. Bratlie

*Attorney, Agent, or Firm*—Chilton, Alix & Van Kirk

[57] ABSTRACT

A lipstick-type cosmetic case with inner and outer coaxial sleeves with respective axial and helical cam tracks receiving cam followers for reciprocating a cosmetic pomade support within the sleeves. The axial cam tracks in the inner sleeve have inner restricted sections with upper tapered end pockets for receiving the cam followers and restricting inward axial movement therefrom. The helical cam tracks in the outer sleeve have upwardly facing continuous helical cam edges on one edge thereof and, on the opposite edge thereof, two inwardly facing stepped helical edge sections and an intermediate inwardly facing locking edge section for locking the followers against outward axial movement from the pockets.

10 Claims, 3 Drawing Sheets

LIPSTICK-TYPE COSMETIC CASE

BACKGROUND OF THE INVENTION

The present invention relates generally to lipstick-type cosmetic cases having a cosmetic pomade carrier adapted to be reciprocated between an inner, fully retracted or storage position and an outer, fully extended or cosmetic apply position. More particularly, the present invention relates to a new and improved cam track mechanism for reciprocating the carrier between its fully retracted and extended positions and for positioning and retaining the carrier in a predetermined stable intermediate position.

Lipstick-type cosmetic cases of the type described conventionally employ a carrier with a cosmetic pomade support cup and a pair of coaxial sleeves surrounding the support cup. The support cup has one or two cam followers received within one or two pairs of axial and helical cam tracks in the sleeves for reciprocating the carrier between its fully retracted and extended positions by relative rotation of the sleeves. Typically, the sleeves are rolled or drawn sheet metal parts or injection molded plastic parts.

Various proposals have been advanced for positioning and retaining the carrier in a predetermined stable position intermediate its fully retracted and extended positions. The primary purpose of such proposals is to enable the cosmetic case to be assembled and marketed with the carrier in the intermediate position for displaying the cosmetic pomade partly extended. The display of the partly extended cosmetic pomade may be accommodated by using a transparent cap and/or a transparent package.

For example, in U.S. Pat. No. 4,108,558, dated Aug. 22, 1978 and entitled "Lipstick Dispenser", a circumferentially extending section is provided in an axial cam track for positioning and retaining the carrier in an intermediate display position. In another example, in U.S. Pat. No. 4,380,402, dated Apr. 19, 1983, entitled "Lipstick-Type Cosmetic Case With Display Position" and assigned to the assignee of the present invention, a circumferentially extending pocket is provided in a helical cam track for positioning and retaining the carrier in an intermediate display position.

BRIEF SUMMARY OF THE INVENTION

A principal object of the present invention is to provide a sleeve mechanism for a lipstick-type cosmetic case of the type described having a new and improved cam track system for positioning and retaining the pomade carrier in a predetermined stable intermediate position.

Another object of the invention is to provide a new and improved sleeve mechanism of the type described having sleeves which can be economically manufactured on a mass production basis by injection molding.

A further object of the invention is to provide a new and improved lipstick-type cosmetic case of the type described which facilitates manually positioning the carrier in a predetermined stable intermediate position. In a conventional manner, the carrier is filled with cosmetic pomade with the carrier in its fully extended position. Then, the carrier is manually retracted to a stable intermediate position for preparing the product for being packaged and marketed with the cosmetic pomade partly extended for display.

Other objects will be in part obvious and in part pointed out more in detail hereinafter.

A better understanding of the invention will be obtained from the following detailed description and accompanying drawings of an illustrative application of the invention.

DESCRIPTION OF PREFERRED EMBODIMENT

Figure 3:
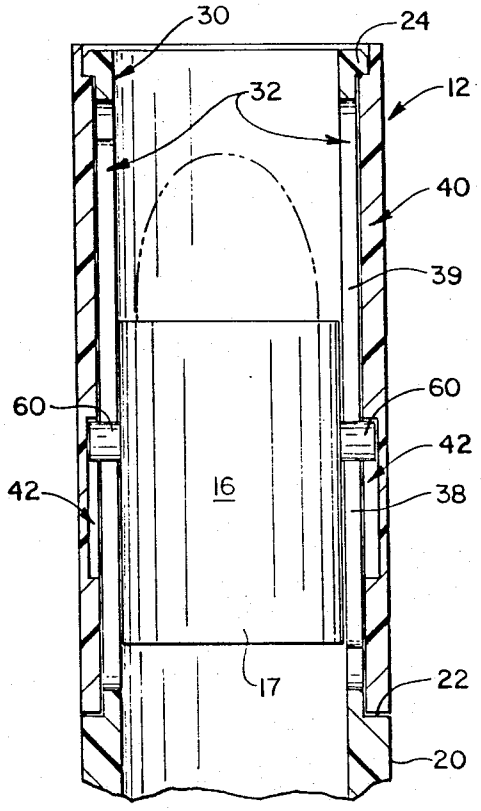
FIG. 3 is an enlarged longitudinal section view, partly in section, of the applicator.
Figure 2:
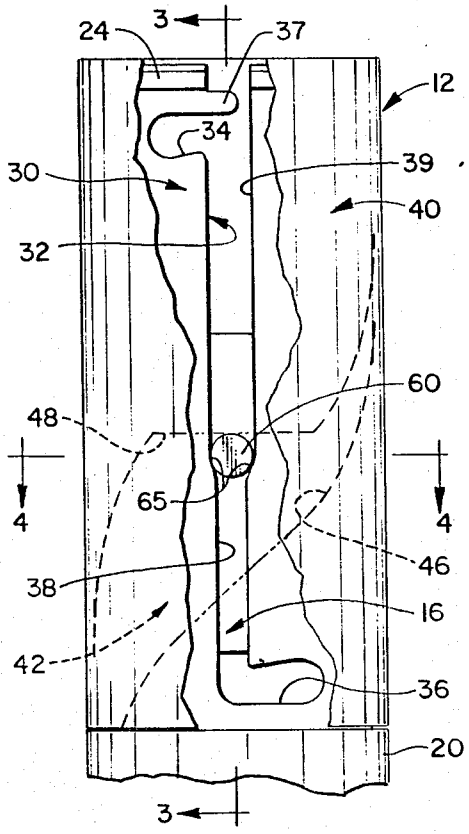
FIG. 2 is an enlarged partial longitudinal view, partly broken away, of a pomade applicator of the cosmetic case of FIG. 1, showing a cam track system of the applicator.

Referring now to the drawings wherein like numerals represent like parts, a lipstick-type cosmetic case 10 incorporating a preferred embodiment of the present invention comprises a generally tubular applicator 12 and a transparent, generally cylindrical cap 14. A cosmetic pomade carrier 16 of the applicator 12 is supported by a sleeve mechanism of the applicator which comprises a pair of coaxial, generally cylindrical inner and outer guide sleeves 30, 40. In a conventional manner, the carrier 16 has a support cup 17 employed to support a lipstick or like cosmetic pomade 18. The support cup 17 is axially reciprocated within the sleeve mechanism between a fully extended pomade apply position and a fully retracted pomade storage position. The cosmetic case 10 is illustrated in FIG. 1 with the carrier and supported lipstick pomade 18 in a predetermined stable display position intermediate the fully extended and retracted positions.

Figure 1:
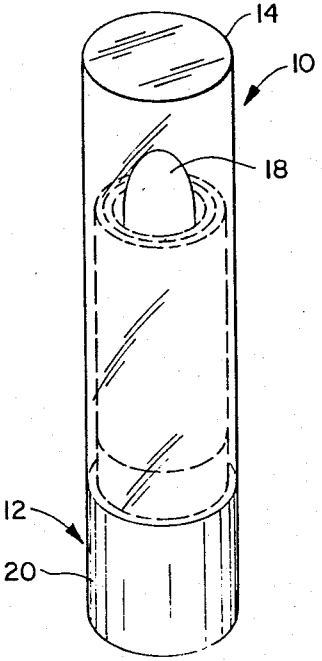
FIG. 1 is a perspective view of a lipstick-type cosmetic case incorporating a preferred embodiment of the present invention, showing the case supporting a lipstick pomade in a stable intermediate position.
Figure 5:
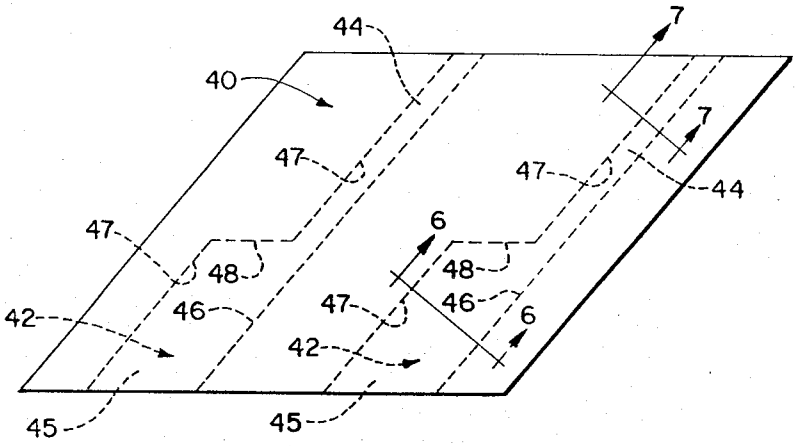
FIG. 5 is an enlarged developed view of an outer sleeve of the applicator, showing the helical cam tracks thereof.
Figure 7:
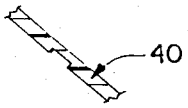
FIGS. 6 and 7 are partial section views, partly broken away, of the outer sleeve of the applicator taken substantially along lines 6—6 and 7—7 respectively of FIG. 5.
Figure 6:
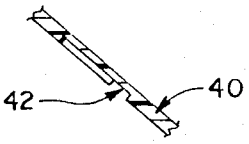
Figure 4:
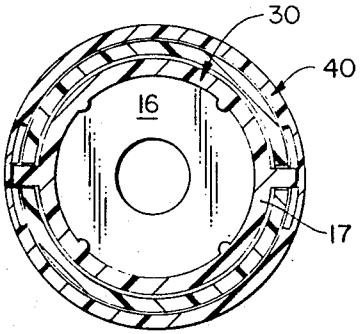
FIG. 4 is a transverse section view, partly in section, of the applicator.
Figure 8A:
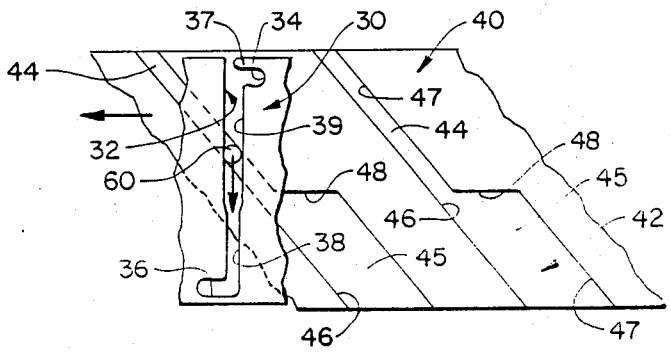
FIGS. 8*a*–8*d* are generally diagrammatic views, partly broken away, of the cam track system, showing a pair of axial and helical cam tracks thereof in different operating positions.
Figure 8B:
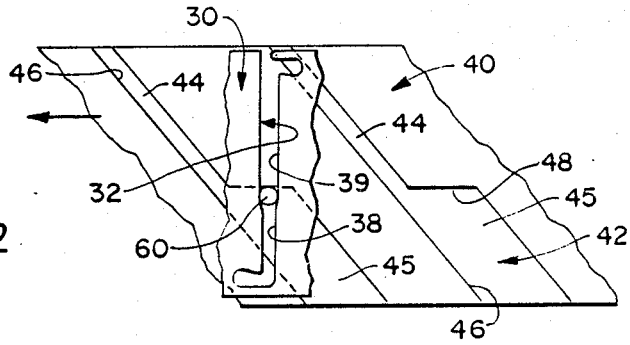
Figure 8C:
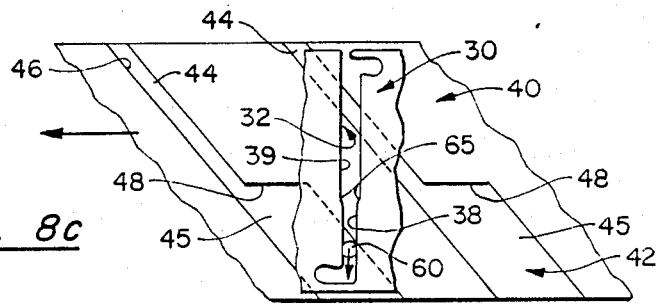
Figure 8D:
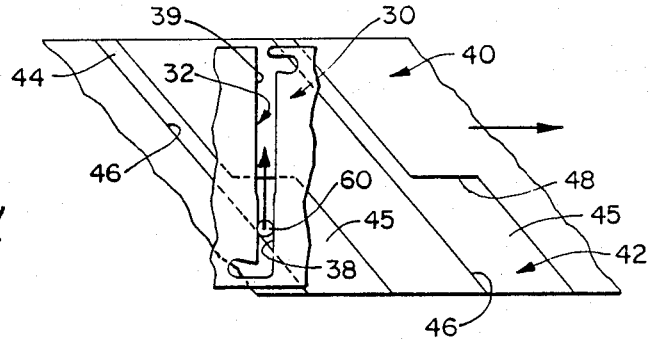

As best shown in FIG. 1, the applicator 12 has a stepped cylindrical base 20 below the pair of coaxial sleeves 30, 40. The inner sleeve 30 and base 20 are provided by a single injection molded plastic part. The outer sleeve 40 is mounted on the inner sleeve 30 for coaxial rotation thereon. The outer sleeve 40 is also an injection molded plastic part. The outer sleeve 40 is axially retained on the inner sleeve 30 between a lower annular shoulder 22 provided by the top of the stepped base 20 and an upper annular shoulder provided by a peripheral annular bead 24 at the upper end of the inner sleeve 30.

The annular bead 24 of the inner sleeve 30 and the upper end of the outer sleeve 40 are configured to enhance the appearance of the sleeve assembly by fully enclosing the upper end of the inner sleeve 30 within the outer sleeve 40. The outer sleeve 40 may be made of opaque plastic having an aesthetically pleasing appearance. As alternatives, the inner and outer sleeves 30, 40 may be made of transparent plastic or a cover sleeve (not shown) may be provided on the outer sleeve to give the desired appearance.

The inner sleeve 30 has a pair of diametrically opposed axial slots or cam tracks 32 having substantially the same shape and configuration (except for the provision of a tab 37 at the upper end of only one of the slots 32). The two axial slots 32 extend from adjacent the lower end of the sleeve 30 to the upper end of the sleeve 30 (thereby bifurcating most of the sleeve 30 into two diametrically opposed, generally semi-cylindrical segments). A lateral slot or cam track offset 34 is provided just below the top of each axial slot 32 and a similar lateral slot or cam track offset 36 is provided at the bottom of each axial slot 32. The cam track offsets 34, 36 extend in opposite circumferential directions and are employed in a conventional manner for retaining the carrier 16 in its fully retracted and extended positions. The tab 37 is provided above the entrance to one of the upper cam track offsets 34 to help guide the carrier to its fully extended position.

Each of the diametrically opposed axial slots 32 is divided into elongated sections 38, 39 having different slot widths. The relatively wide slot section 39 is provided at the upper or outer end of each axial slot 32 and the relatively narrow slot section 38 is provided at the inner or lower end of each axial slot 32. Each section 38, 39 has a uniform width except for the tab 37 and except that the lower narrow section 38 has an upwardly and outwardly tapered upper end providing a smooth cam track transition to the upper wide section 39.

The outer sleeve 40 has a pair of helically extending grooves or cam tracks 42 on its inner generally cylindrical surface. The grooves 42 are diametrically opposed and have substantially the same shape. Each groove 42 is divided into an upper relatively narrow section 44 and a lower relatively wide section 45. The two sections have the same helix angle.

Viewing the applicator 12 from above, the counterclockwise or upwardly facing edge or shoulder 46 of each helical cam track 42 provides a continuous helical cam edge as shown in FIGS. 5 and 8*a*–8*d*. The other, clockwise or downwardly facing edge or shoulder 47 of each helical track 42 provides stepped helical cam edge sections as also seen in FIGS. 5 and 8*a*–8*d*. Transverse or circumferential, downwardly facing locking edges or shoulders 48 are provided at the transition between the two cam edge steps or sections of the stepped edge 47. The locking shoulders 48 are parallel and in diametrically opposed relationship. The locking shoulders 48 lie in a common transverse plane immediately above the upper tapered ends of the lower axial slot sections 38 and face axially downwardly toward those slot sections 38.

The carrier 16 is an injected molded plastic part of conventional construction The carrier support cup 17 has a pair of integral, diametrically opposed lugs or pins 60 which serve as cam followers. Each cam follower 60 is circular and extends radially outwardly through one of the axial slots 32 of the inner sleeve 30 and into one of the helical grooves 42 of the outer sleeve 40. Relative rotation of the inner and outer sleeves 30, 40 drives the followers along the cam tracks 32, 42 to axially position the carrier support cup 17 within the sleeves.

To facilitate assembly of the carrier and coaxial sleeves 30, 40, the axial slots 32 of the inner sleeve and the internal grooves 42 of the outer sleeve extend to the outer ends of the sleeves for receiving the cam followers 60. The retention tab 37 of the inner sleeve 30 is dimensioned to permit insertion of the respective cam follower 60 past the tab 37 and yet to retain the carrier 16 below the tab 37 after assembly.

Manual relative rotation of the sleeves 30, 40 reciprocates the carrier 16 between its fully retracted position (where the supported lipstick pomade 18 is retracted completely into the sleeves) and a fully extended position (where the lipstick pomade 18 projects from the sleeves for cosmetic application). In a conventional manner, relative rotation of the sleeves 30, 40 may be accomplished by holding the outer sleeve (or any cover sleeve (not shown) mounted thereon) with one hand and manually rotating the base 20 with the other hand. Relative rotation in one direction drives the carrier 16 in one axial direction and relative rotation in the opposite direction drives the carrier 16 in the opposite axial direction. The continuous, upwardly facing helical cam edges 46 of the two helical cam tracks 42 cam the carrier 16 upwardly upon relative rotation of the sleeves 30, 40 in one direction. The other, downwardly facing, stepped helical edges 47 of the two helical cam tracks 42 cam the carrier 16 inwardly upon relative rotation of the sleeves 30, 40 in the opposite direction. The end offsets 34, 36 receive and axially support the followers 60 in the end positions of the carrier 16 to lock the carrier 16 against inadvertent axial displacement.

The axial and helical cam tracks 32, 42 cooperate to position and retain the carrier 16 in a predetermined stable position intermediate its fully extended and retracted positions. The width of the upper axial slot sections 39 (0.101 inch in the disclosed embodiment) is slightly greater than the diameter of the cam followers 60 (0.088 inch in the disclosed embodiment) to permit the followers 60 to travel freely along those sections 39 in a conventional manner. When retracting the carrier 16 from its fully extended position, the cam followers 60 are retracted along the upper slot sections 39 to a predetermined intermediate position just above or just engaging the tapered edges of the upper ends of the lower narrow slot sections 38. Those upper tapered ends provide intermediate retaining pockets 65 for positioning the cam followers 60 and restraining them against further downward axial displacement. Further downward axial displacement is restrained because the cam followers 60 are slightly larger than the elongated narrow axial slot sections below the pockets 65. For example, each elongated slot section below the pocket 65 has a normal slot width (0.084 inch in the disclosed embodiment) which provides a 0.004 inch interference.

The width of the upper helical sections 44 (0.115 inch in the disclosed embodiment) is slightly greater than the diameter of the cam followers 60 to permit the followers to travel freely along those sections in a conventional manner. The width of the lower helical sections 45 (0.300 inch in the disclosed embodiment) is several times greater than the diameter of the cam followers 60. Therefore, the circumferential length of the transverse shoulders 48 is also several times greater than the diameter of the cam followers 60.

The transverse shoulders 48 are axially located relative to the tapered end pockets 65 of the inner sleeve 30 so that after the cam followers 60 are retracted to their predetermined intermediate position within the retaining pockets 65, further relative rotation of the sleeves 30, 40 positions the cam shoulders 48 directly above the cam followers 60. The cam shoulders 48 are then positioned to retain the cam followers 60 against axial displacement in the upper or outward axial direction. The carrier 16 is then held in a stable intermediate position (with the cosmetic pomade partly extending from the sleeve mechanism) by the tapered end pockets 65 of the inner sleeve 30 and the transverse shoulders 48 of the outer sleeve 40. When retracting the carrier from its fully extended position, after the cam followers 60 are retracted to the intermediate retaining pockets 65, the succeeding slight relative rotation of the sleeves 30, 40 is free of further inward movement of the followers 60 and thus is accompanied by lower frictional resistance which signals that the carrier 16 is in the desired intermediate position.

The lower elongated slot sections below the pockets 65 are only slightly narrower than the cam followers 60 to permit axial movement of the followers 60 therealong accompanied by slight outward expansion of the inner sleeve 30 (i.e., slight separation of the two semi-cylindrical segments of the bifurcated inner sleeve 30). The parts are dimensioned so that the resistance provided by those narrow slot sections is overcome with relatively little additional torque to provide for withdrawal of the carrier 16 to its fully retracted position. However, with the carrier 16 in its intermediate position with the cam followers 60 in the tapered end pockets 65 and below the transverse shoulders 48, inadvertent displacement of the carrier 16 during storage, shipment and normal handling is prevented.

Although the above-described orientation of the axial and helical cam tracks 32, 42 is preferred, the axial and helical cam tracks may be reversed end for end if desired. That is, the wide helical slot sections and narrow axial slot sections may be provided at the upper ends of the respective sleeves instead of at the lower ends. Also, the axial and helical cam tracks 32, 42 preferably are provided on the inner and outer sleeves 30, 40 respectively as disclosed. That could be reversed if desired to provide the helical cam tracks on the inner sleeve (in which event the helical cam tracks would be provided by slots) and the axial cam tracks on the outer sleeve. Further, if desired, only one of the two axial cam tracks 32 could be formed with a narrow or restricted cam track section 38 or only a single cam follower 60 and corresponding single pair of cooperating axial and helical cam tracks 32, 42 could be employed in place of the dual follower and dual cam track system shown and described.

Although the drawings and description disclose the preferred embodiment of the present invention, they should not be deemed to limit the invention. Various modifications, adaptations and alternatives to the preferred embodiment may occur to one skilled in the art without departing from the spirit and scope of the present invention.

What is claimed is:

1. In a cosmetic applicator having inner and outer, generally cylindrical, relatively rotatable, coaxial sleeves with cooperating cam tracks and a carrier with a cosmetic support mounted within the sleeves and cam follower means received within the cooperating can tracks for reciprocating the carrier inwardly and outwardly between an inner fully retracted position and an outer fully extended position by relative rotation of the sleeves in opposite directions, the cooperating cam tracks comprising at least one pair of cooperating, generally axial and helical cam tracks for positioning the carrier in a predetermined stable intermediate position thereof, the improvement wherein each said pair of cam tracks comprises first and second contiguous pairs of cooperating sections of said axial and helical cam tracks, the first pair of cooperating sections freely receiving the cam follower means for unrestricted movement therealong and comprising a first unrestricted section of said axial cam track and a first unrestricted section of said helical cam track, each having a substantially constant width along the full length thereof, the second pair of cooperating sections comprising a second restricted section of said axial cam track slightly narrower than the cam follower means for restricted movement of the cam follower means therealong and a second unrestricted section of said helical cam track having a substantially constant width along the full length thereof which is substantially greater than the width of said first section of said helical cam track, said first and second helical cam track sections together providing, along the full length of one edge thereof, one continuous, helically extending cam edge and, along the full length of the opposite edge thereof, a pair of circumferentially stepped, continuous, helically extending cam edge section s and a circumferentially extending locking edge section therebetween having a circumferentially length greater than the width of the cam follower means, the locking edge section facing in one axial direction toward said second restricted section of said axial cam track and axially located to cooperate to retain the cam follower means therebetween to retain the carrier in a corresponding stable intermediate position.

2. A cosmetic applicator according to claim 1 wherein the coaxial sleeves have two of said pairs of cam tracks in generally diametrically opposed relationship.

3. A cosmetic applicator according to claim 2 wherein the generally axial cam tracks of said two pairs of cam tracks are provided by axial slots in the inner sleeve which extend to the outer axial end thereof to bifurcate the inner sleeve, at least in part, into two diametrically opposed generally semicircular segments, each second section of said axial cam track having a tapered end providing a smooth transition to the first section of the axial cam track and forming a pocket for receiving the cam follower means in said stable intermediate position of the carrier.

4. A cosmetic applicator according to claim 1 wherein the second section of said axial cam track has a tapered end providing a smooth transition to the first section of said axial cam track and forming a pocket for receiving the cam follower means in said stable intermediate position of the carrier.

5. A cosmetic applicator according to claim 1 wherein the pair of cooperating, generally axial and helical cam tracks are provided on the inner and outer sleeves respectively.

6. A cosmetic applicator according to claim 1 wherein the first pair of cam track sections are provided at the outer axial ends of the sleeves and the second pair of cam track sections are provided at the inner axial ends of the sleeves.

7. In a cosmetic applicator having inner and outer, generally cylindrical, relatively rotatable, coaxial sleeves with cooperating cam tracks and a carrier with a cosmetic support mounted within the sleeves and cam follower means received within the cooperating cam tracks for reciprocating the carrier inwardly and outwardly between an inner fully retracted position and an outer fully extended position by relative rotation of the sleeves in opposite directions, the cooperating cam tracks comprising at least one pair of cooperating, generally axial and helical cam tracks for positioning the carrier in a predetermined stable intermediate position thereof, the improvement wherein said pair of cam tracks comprises first and second contiguous pairs of cooperating cam track sections, the first pair of cam track sections freely receiving the cam follower means for unrestricted movement therealong and comprising a first unrestricted section of said axial cam track and a first unrestricted section of said helical cam track, each having a substantially constant width along the full length thereof, the second pair of cam track sections comprising a second section of said axial cam track having a pocket for receiving the cam follower means and configured to restrain movement of the cam follower means in one axial direction therefrom and a second unrestricted section of said helical cam track having a substantially constant width along the full length thereof which is substantially greater than the width of said first section of said helical cam track, said first and second helical cam track sections together providing, along the full length of one edge thereof, one continuous, helically extending cam edge and, along the full length of the opposite edge thereof, a pair of circumferentially stepped, continuous, helically extending cam edge sections and a circumferentially extending locking edge section therebetween having a circumferential length greater than the width of the cam follower means, the locking edge section facing in said one axial direction and axially located in the opposite axial direction from the pocket to retain the cam follower means in the pocket and thereby retain the carrier in a corresponding stable intermediate position.

8. A cosmetic applicator to claim 7 wherein the generally axial cam track is provided by a generally axial slot in the inner sleeve divided into said first and second axial sections and the generally helical cam track is provided by an inner groove in the outer sleeve divided into said first and second axial sections.

9. A cosmetic applicator according to claim 8 wherein the first axial cam track section is outwardly of the second axial cam track section.

10. A cosmetic applicator according to claim 9 wherein the first axial cam track section has a generally uniform width and wherein the second axial cam track section has generally uniform width less than the width of the first axial cam track section except for a tapered end forming said pocket and providing a smooth transition to the first axial cam track section.

* * * * *

UNITED STATES PATENT AND TRADEMARK OFFICE

CERTIFICATE OF CORRECTION

PATENT NO. : 4,984,919

DATED : January 15, 1991

INVENTOR(S) : George W. Hultgren

It is certified that error appears in the above-identified patent and that said Letters Patent is hereby corrected as shown below:

Column 5, line 64, change "can" to -- cam --.

Column 6, lines 25-26, change "section s" to -- sections --.

Column 6, line 27, change "circumferentially" to -- circumferential --.

Column 8, line 11, after "applicator" , insert -- according --.

Column 8, line 23, after "has" , insert -- a --.

Signed and Sealed this

First Day of September, 1992

*Attest:*

DOUGLAS B. COMER

*Attesting Officer*

*Acting Commissioner of Patents and Trademarks*